US005493979A

United States Patent [19]

Ackermann et al.

[11] Patent Number: 5,493,979

[45] Date of Patent: Feb. 27, 1996

[54] INDEPENDENT GUIDE SYSTEM FOR UPPER ROLLER FEEDER

[75] Inventors: Manfred Ackermann, Elmhurst; Troy Vanderhoof, McHenry; David Wilke, Rockford, all of Ill.

[73] Assignee: Union Special Corporation, Huntley, Ill.

[21] Appl. No.: 237,341

[22] Filed: May 3, 1994

[51] Int. Cl.[6] ..... D05B 27/10

[52] U.S. Cl. ..... 112/318; 112/322

[58] Field of Search ..... 112/314, 318, 112/322, 220

[56] References Cited

U.S. PATENT DOCUMENTS

| | | | |
|---|---|---|---|
| 1,988,372 | 1/1935 | Christensen et al. | 112/322 |
| 1,990,616 | 2/1935 | Rubel | 112/322 |
| 2,035,365 | 3/1936 | Clayton | 112/322 |
| 2,494,888 | 1/1950 | Vesconte et al. | 112/322 |
| 2,678,010 | 5/1954 | Pinkvoss | 112/322 |
| 2,692,568 | 10/1954 | Galkin | 112/322 |
| 2,730,977 | 1/1956 | Hayes et al. | 112/322 |
| 3,003,443 | 10/1961 | Condran | 112/322 |
| 3,726,240 | 4/1973 | Emich | 112/322 X |
| 3,853,078 | 12/1974 | Marforio | 112/2 |
| 4,073,248 | 2/1978 | Marforio | 112/322 |
| 4,152,995 | 5/1979 | Klundt | 112/318 |
| 4,462,530 | 7/1984 | Block et al. | 112/322 X |
| 4,572,094 | 2/1986 | Taddicken | 112/322 |
| 4,854,254 | 8/1989 | Hsing | 112/305 |

FOREIGN PATENT DOCUMENTS

| | | |
|---|---|---|
| 312545 | 8/1928 | United Kingdom . |
| 837654 | 6/1960 | United Kingdom . |
| 2204333 | 11/1968 | United Kingdom . |
| 2219604 | 12/1989 | United Kingdom . |

OTHER PUBLICATIONS

Union Special, 35800 High Speed Feed-Off-The-Arm with plain Feed (Manual No. PT9410), Apr. 1994.

Union Special Catalog No. 95DM, Class 35800, High Speed Feed-Off-The-Arm Machines with Differential Feed. (May 1981).

Union Special Catalog No. 95W, Classes 35700, 35800, High Speed Feed-Off-The-Arm Machines Jul. 1980.

*Primary Examiner*—Ismael Zaguirre

*Attorney, Agent, or Firm*—Willian Brinks Hofer Gilson & Lione

[57] ABSTRACT

A guide mechanism for the roller presser bar of a sewing machine of the type that includes an upper surface roller feeder for imparting movement to the upper work surface and a presser foot that cooperates with the feed dog. The guide mechanism for the roller presser bar is independent of the guide mechanism for the presser foot bar. The independent guide mechanism for the roller presser bar avoids binding of the roller presser bar that occurs when a common guide mechanism is utilized for both the roller presser and the presser foot bar. The roller presser bar guide mechanism includes a pair of movable vertically aligned surfaces attached to the bar and a cooperating block attached to the sewing machine housing with a pair of adjustable guide plates.

4 Claims, 5 Drawing Sheets

FIG. 5
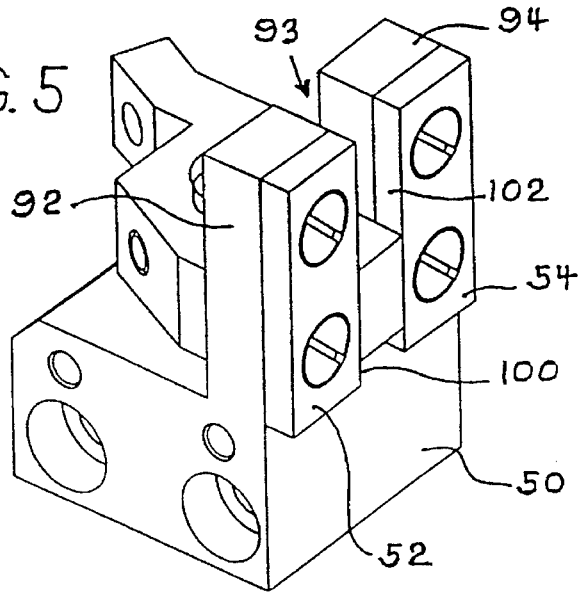
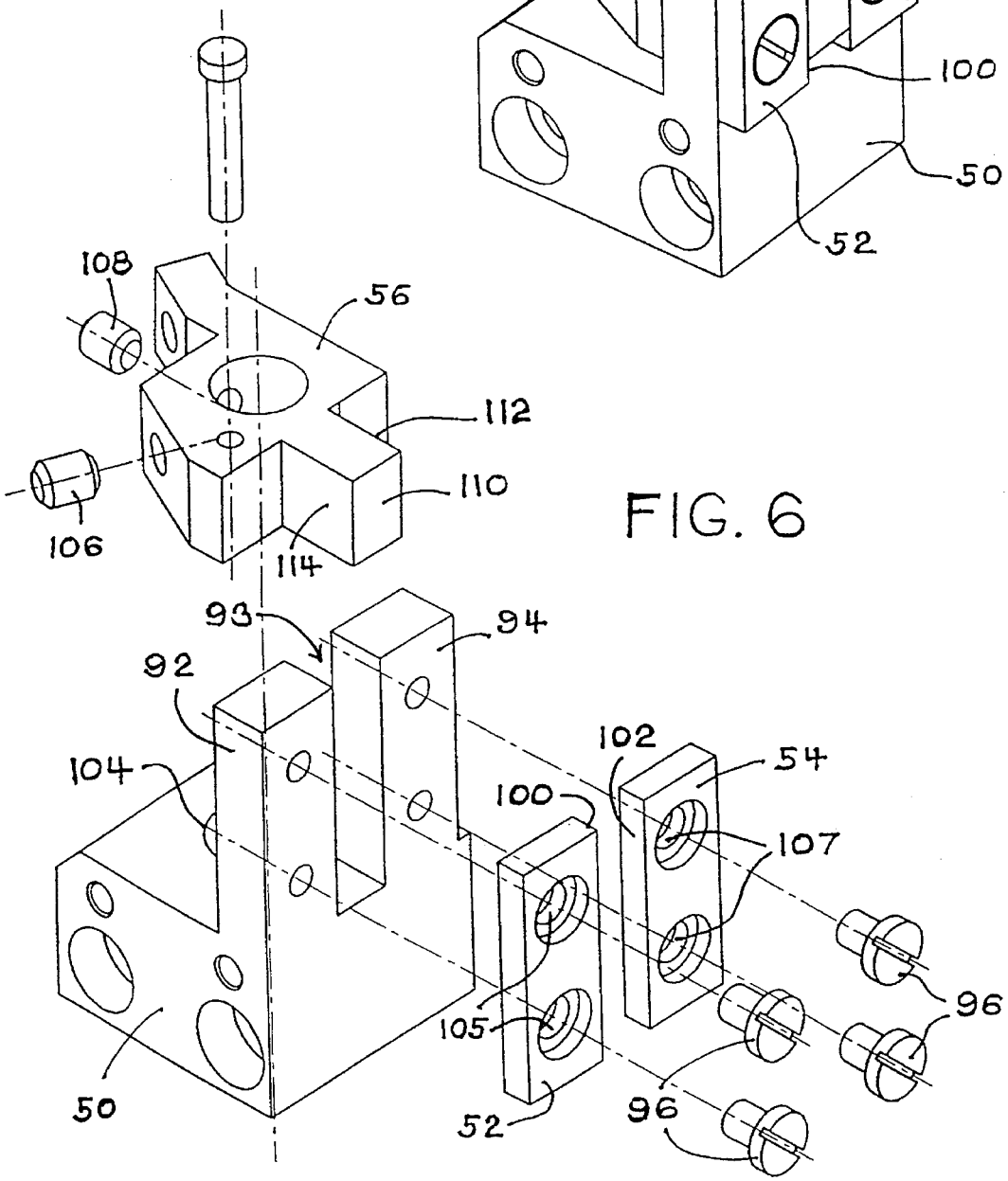
FIG. 6

INDEPENDENT GUIDE SYSTEM FOR UPPER ROLLER FEEDER

CROSS-REFERENCES

The present application is related to application serial number 08/223,640 filed on Apr. 6, 1994, entitled "Belt Drive Puller Mechanism," that is now U.S. Pat. No. 5,448,959; and is assigned to the same assignee as is this application. Application 08/223,640 is hereby incorporated herein by reference.

BACKGROUND OF THE INVENTION

This invention relates to sewing machines and particularly to an improved work piece feeding mechanism of the type that imparts feeding action to both the top and bottom surfaces of the work piece in timed relationship with the stitch forming mechanism.

For sewing operations involving fabrics, such as relatively thick denim used in jeans that is difficult to feed as well as other operations where the control of the fabric layers relative to each other is critical, feeding devices that impart a feeding action to both the upper and lower surface of the work piece are used.

Machines of this type find particular application when joining the legs of jeans. In this operation an abrupt change from four plies to sixteen plies of material is encountered. The superior ability to accurately control and feed uniquely qualifies machines of this type to successfully accomplish this task.

The lower surface feeder includes a presser foot, which is located above the work piece, and feed dogs which are located below the work piece. The work piece is grasped by the teeth of the feed dogs, in engagement with the lower surface of the work piece, and pulled horizontally along the lower smooth surface of the presser foot.

The drive mechanism for the upper surface roller feeder, which is a critical element of this device, includes a roller that is biased downwardly toward the throat plate. The aggressive surface of the roller engages the upper surface of the work piece and when rotated pulls the work piece along the smooth upper surface of the throat plate.

The upper surface roller feeder must be synchronized with the lower surface feeder and with the needle drive and must be driven intermittently so that movement is imparted to the work piece only when the needle is not penetrating the work piece. The needle and looper mechanisms are also carefully synchronized. The roller for the upper feeder and the presser foot for the lower feeder must be free to move vertically in response to changes in the work piece thickness or contour. However, the roller for the upper feeder and the presser foot for the lower feeder contact different areas of the upper surface of the work piece at a given time. For this reason, the roller for the upper feeder and the presser foot must be able to move vertically independently of each other. When the guide mechanisms for the upper feeder roller and the presser foot are interdependent, these elements can bind as a result of wear to the guide mechanisms, which locks the elements together and prevents independent movement.

The Union Special Corporation, class 35800 Feed-Off-The-Arm sewing machine includes a mechanism for imparting a feeding action to both the upper and lower surfaces of the work piece. The Union Special Corporation, class 35800 sewing machine is disclosed in Union Special Catalog No. 95DM. The presser foot has an upper guide mechanism that is located at the upper end of the presser foot bar within the head of the sewing machine. This upper guide mechanism functions solely to guide the presser foot. A second or lower guide system for the presser foot and the feed roller is located at the lower end of the presser foot bar. This lower guide system includes sliding surfaces on the presser foot mechanism and on the feed roller mechanism that permit independent movement of these elements. The presser foot mounting fork, which is a cast component carried by the lower end of the presser foot bar, has a first set of parallel vertically oriented machined surfaces. The feed roller frame, which is also a cast element has a second set of parallel vertical oriented machined surfaces. The engagement of the first and second sets of machined surfaces functions to maintain proper alignment of the upper surface roller feeder and the presser foot. However, when these sliding surfaces wear, the elements can twist relative to each other and under some conditions cause the elements to bind and thus not operate independently. When this occurs the operation of the machine is adversely affected and the machine must be serviced. Since the sliding surfaces are formed on structural parts of the sewing machine, when the surfaces have worn such that machine operation is no longer acceptable the entire elements must be removed and replaced. This is a time consuming and expensive repair operation which idles the sewing machine and often the operator for prolonged periods of time. In this machine the drive for the feed roller mechanism is derived from the main drive shaft through an eccentric and pitman that oscillates a bellcrank which is connected to an input clutch drive member through a connecting bar. The clutch imparts a drive motion, in one direction, to the drive mechanism for the upper surface feeder.

SUMMARY OF THE INVENTION

The present invention is directed to a guide mechanism for the upper surface roller feeder that is separate and distinct from the presser foot guide system. The upper surface roller guide system includes adjustable and replaceable guide plates that function to assure that the upper surface roller guide system works properly. The guide plates can be easily adjusted and when wear becomes severe they can be easily and conveniently replaced without removing structural parts of the sewing machine. The presser foot has its own independent guide system that also includes adjustable and replaceable guide plates.

By providing separate and distinct guide systems for the presser foot and the upper surface roller feeder, the possibility that the presser foot and the upper surface roller feeder will bind and fail to operate independently has been eliminated. Furthermore, the guide system for the upper surface roller feeder can be adjusted to maintain precise control of the upper surface roller feeder and the replaceable plates can be removed and replaced without removing any structural parts of the sewing machine.

The guide system for the presser foot is no longer relied upon to perform the dual function of also guiding the upper surface roller feeder and has thus been relieved of a major portion of the stresses that it had been subjected to, the twisting tendency caused by the combined guide systems, and thus fulfills its function of vertically guiding the presser foot more accurately and its useful life has been greatly extended.

Thus the guide systems for both the presser foot and the upper surface roller feeder have been improved. Not only does this improve the overall operation of the machine but it reduces considerably the maintenance required on the machine.

Although in the prior art sewing machines, binding of the presser foot and roller drive did not occur often, even an occasional event of unacceptable operation is undesirable in commercial sewing operations since it results in unacceptable work products and down time for the machine and operator. The reduction of the binding of the presser foot and the upper surface roller feeder improves the sewing machine's reliability, operation and output. This constitutes a very important and significant improvement to machines of this type. The binding of the presser foot and drive roller in the prior art machines also limited the machine's useful life and had adverse affects on other parts of the sewing machine.

Applicants' invention can be used as a modification to a machine of the type in which drive for the upper surface roller feeder is derived from the main drive shaft through an eccentric and pitman that oscillates a bellcrank which is connected to an input clutch drive member through a connecting bar. However, it can also be used with a machine of the type disclosed in the above identified application Ser. No. 08/223,640 in which a timing belt is used for driving the upper surface roller feeder and an improved clutch mechanism and drive link assembly is provided that can accommodate different stitch lengths. In this type of machine the one way roller clutches contribute significantly to noise and vibration reductions. Also the this machine provides for a wider range of stitch adjustments and easy access to accomplish the adjustments.

For the foregoing reasons, there is a need for independent guide systems for the presser foot and the upper surface roller feeder in commercial sewing machines of this type.

The guiding mechanism for the upper roller feeder system comprises a guiding block that is fixed to the head of the sewing machine and to which is adjustably mounted a pair of replaceable guide plates. A roller presser bar guide is secured to the roller presser bar and includes a projection having a set of parallel surfaces that are located to engage the edges of the adjustable guide plates. The clearance between the vertical machined surfaces on the presser foot and on the upper surface roller feeder frame in the prior art machine has been increased such that it no longer functions as a guiding system that interconnects the presser foot and the upper surface roller feeder. The upper presser foot guide system of the prior art is maintained. However, since the upper presser foot mechanism has been relieved of a major portion of the stresses that it had been subjected to, its useful life has been greatly extended.

The guide system for the material drive systems of the present invention is more durable, is adjustable and can be serviced or replaced without replacing structural parts of the machine. This new and improved guide system is a substantial improvement over the prior art mechanisms.

For the foregoing reasons there is a need for a drive mechanism for an upper surface roller feeder that produces a more acceptable level of vibrations and sound levels than that produced by current devices.

BRIEF DESCRIPTION OF THE DRAWINGS

FIG. 5 is an isolated perspective view of the guide mechanism for the upper surface roller feeder component seen in FIG. 3.

FIG. 6 is an exploded perspective view of the guide mechanism for the upper surface roller feeder component seen in FIG. 5.

DETAILED DESCRIPTION OF TEE PREFERRED EMBODIMENT

Figure 1:
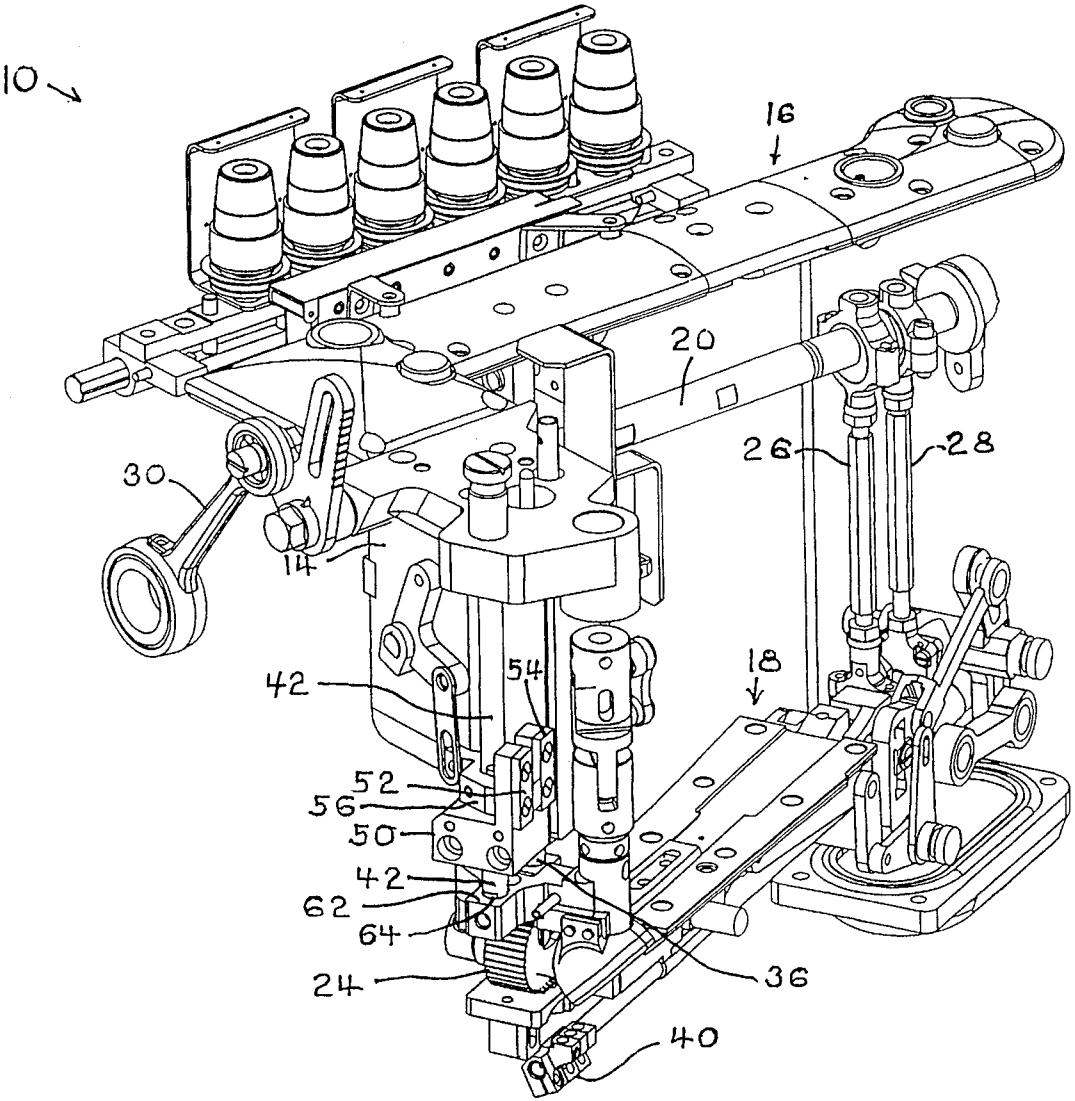
FIG. 1 is a perspective view of a sewing machine with the outer housing removed such that the parts are seen in their actual position in the machine and in the proper relationship to other parts of the machine.
Figure 2:
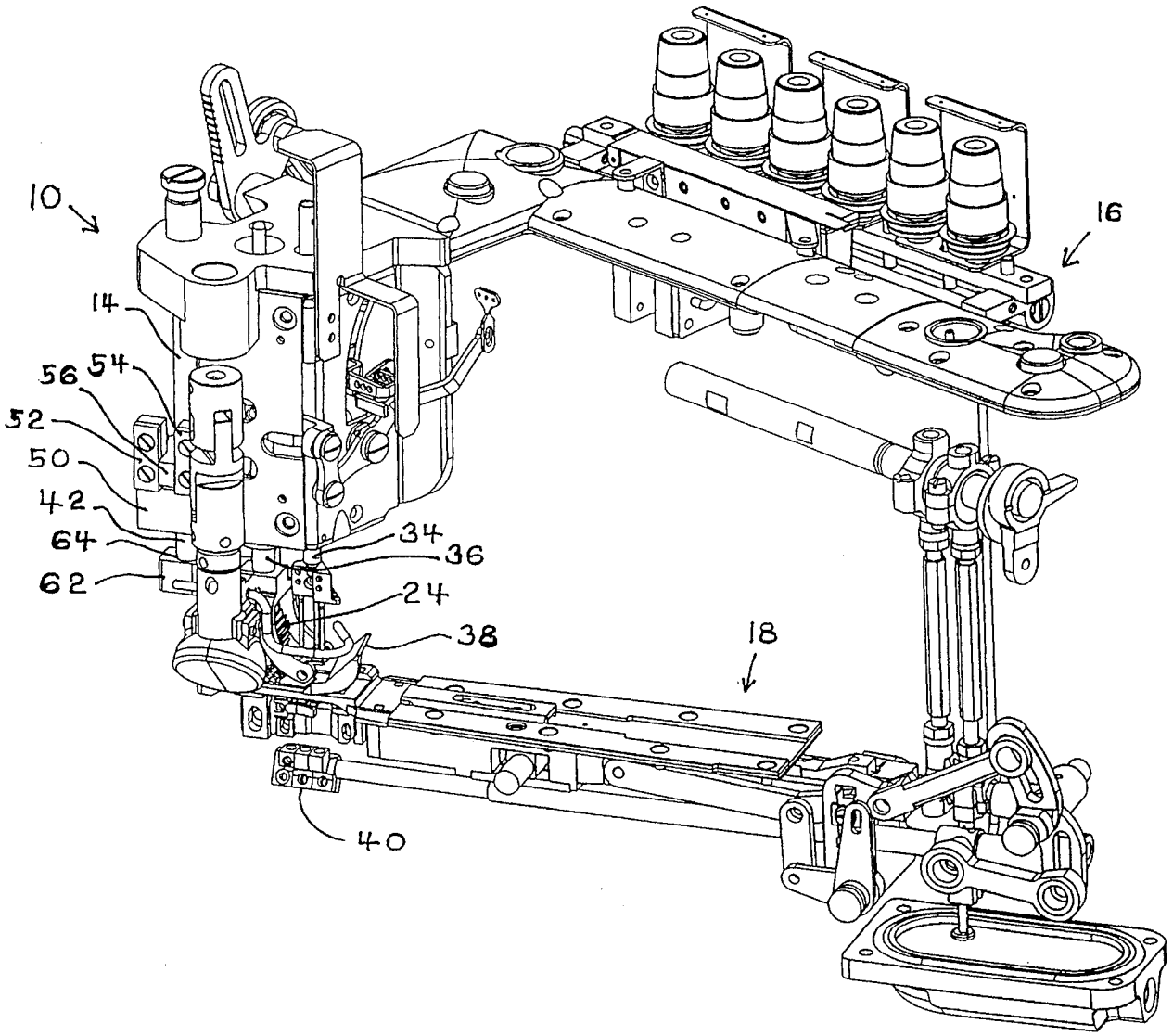
FIG. 2 is a perspective view, from a different angle than FIG. 1, of a sewing machine with the outer housing removed such that the parts are seen in their actual position in the machine and in the proper relationship to other parts of the machine.

There is shown in FIGS. 1 and 2 different views of the sewing machine 10. Most of the outer housing is not shown which enables the parts to be seen in their actual position, however a portion of the housing is shown. The portion of the housing seen in these views is the detachable head portion 14 that is located at the free end of the sewing machine arm 16. The sewing machine arm 16 extends substantially horizontally from a vertical support portion of the sewing machine. The lower end of the vertical support portion is secured to the base 18 of the sewing machine. The sewing machine is driven by a conventional power input pulley, located adjacent the detachable head portion 14, that drives the crankshaft 20. Power for driving the stitch forming mechanism such as the needles 22, loopers, upper feed roller 24 and feed dogs is supplied through connecting rods 26, 28 and 30 that are driven by the crankshaft 20. The needle bar 34, presser bar 36, presser foot 38, looper holders 40, roller presser bar 42 and upper feed roller 24 are shown in their actual positions in the sewing machine. Some unique parts of this invention such as the guiding block 50, guide plates 52 and 54 and feed bar guide 56 can also be seen in FIGS. 1 and 2.

Figure 3:
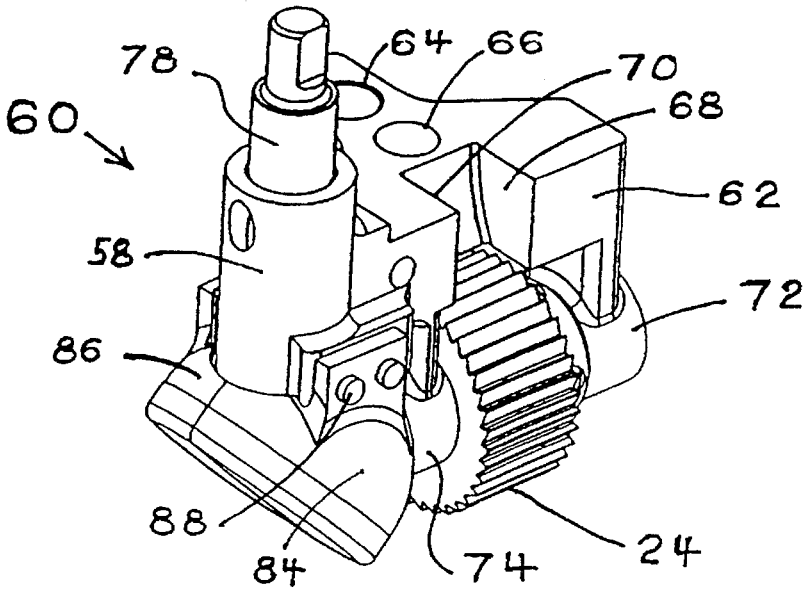
FIG. 3 is an isolated perspective view of the upper surface roller feeder component.

There is shown in FIG. 3 an assembled upper surface roller feeder 60. The direction of work material feed is indicated by the arrow in this view. The portion of the upper surface roller feeder 60 into which work material is fed is referred to as its forward end. Upper surface roller feeder 60 includes a cast feed roller frame 62 and has two vertical bores 64 and 66 formed therein. Vertical bore 64 receives the roller presser bar 42 in a free sliding relationship as shall be presently discussed in more detail. The relationship between the roller presser bar 42 and the upper surface roller feeder 60 is best seen in FIG. 1.

There is a notch formed in the forward end of the feed roller frame 62 that provides a pair 68, 70 of flat spaced apart vertical surfaces.

A pair of bearing blocks 72, 74 extend downwardly from the bottom surface of the feed roller frame 62 for journalling a feed roller shaft 76 (see FIG. 4) upon which is secured the upper feed roller 24. Protruding from one side of the feed roller frame 62 is a bearing block 58 for receiving the vertical drive shaft 78 for the upper feed roller 24. Driven vertical shaft 78 is journalled in bearing block 58 and has a drive miter gear 80 secured to its lower end. A mating driven miter gear 82 is carried by feed roller shaft 76 such that it meshes with drive miter gear 80. Front and rear gear guards 84 and 86 are secured by fasteners 88 to the feed roller frame 62 and function to form a lubrication case for the miter gears 80 and 82.

Figure 4:
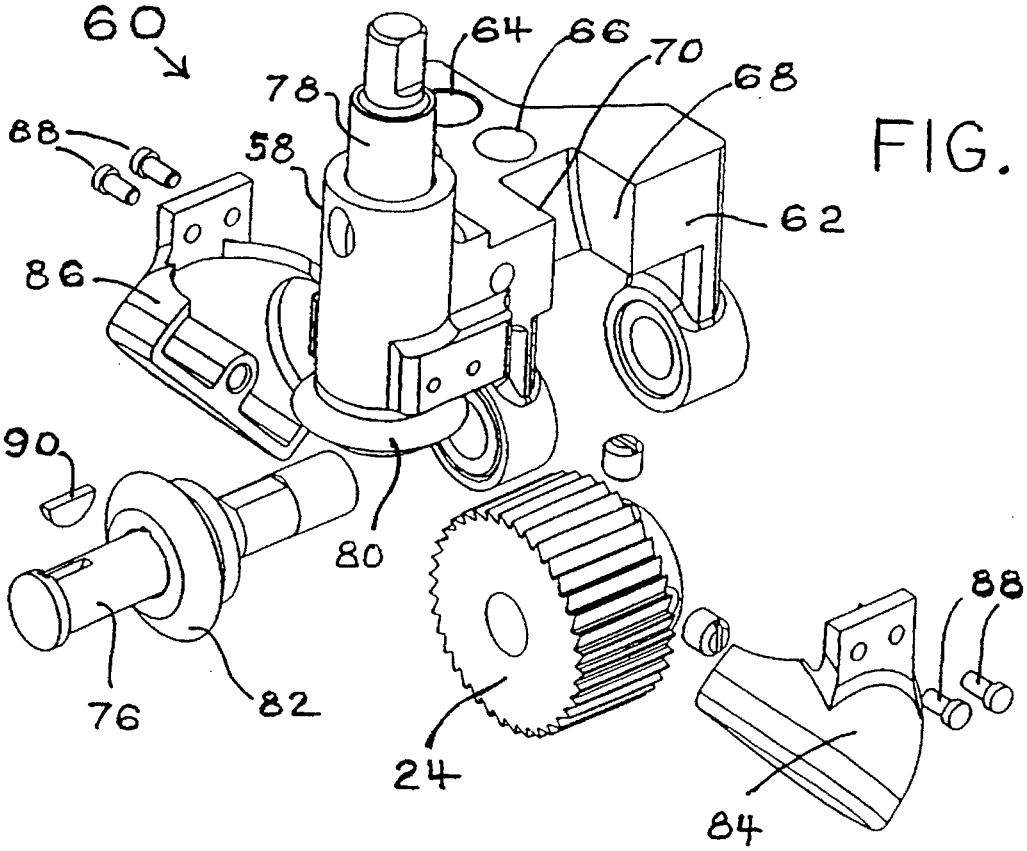
FIG. 4 is an exploded view of the upper surface roller feeder component seen in FIG. 3.

The above description of the upper surface roller feeder 60 is equally applicable to FIG. 4 which shows the parts of the upper surface roller feeder 60 in exploded form. In FIG. 4 a woodruff key 90 is shown which functions to secure driven miter gear 82 to feed roller shaft 76.

Referring now to FIGS. 5 and 6 the new and improved independent guiding mechanism for the upper surface roller feeder component 60 is shown. The guiding block 50 includes a pair of upwardly projecting rectangular shaped posts 92 and 94. The upwardly projecting rectangular shaped posts 92 and 94 define a vertically extending slot 93 therebetween. Adjustable and replaceable guide plates 52 and 54, having flat engaging surfaces 100 and 102, are secured to the rectangular shaped post 92 and 94 by fasteners 96. The relatively thin portions of the fasteners 96 extend through openings 105 and 107 formed in the guide plates 52 and 54. The openings 105 and 107 are larger in diameter than the relatively thin portions of the fasteners 96, thus adjustment of the guide plates 52 and 54 relative to the guiding block 50 can be accomplished.

The overall guide block 50 is fixed to the detachable head portion 14 which is a part of the sewing machine housing. The flat engaging surfaces 100 and 102 remain stationary during the operation of the sewing machine. A vertical bore 104 is formed in the guiding block 50 into which the roller presser bar 42 loosely slides.

An upper roller feed bar guide 56 is secured to the roller presser bar 42 by a pair of fasteners 106 and 108. The upper surface roller feeder bar guide 56 has a protuberance 110 extending from one side thereof that includes a pair of movable vertically aligned guide surfaces 112 and 114. The protuberance 110 is dimensioned to extend loosely through and reciprocate within the vertically extending slot 93 such that the movable vertically aligned guide surfaces 112 and 114 are in close sliding relationship with the stationary vertically aligned flat engaging surfaces 100 and 102 of the guide plates 52 and 54.

Figure 7:
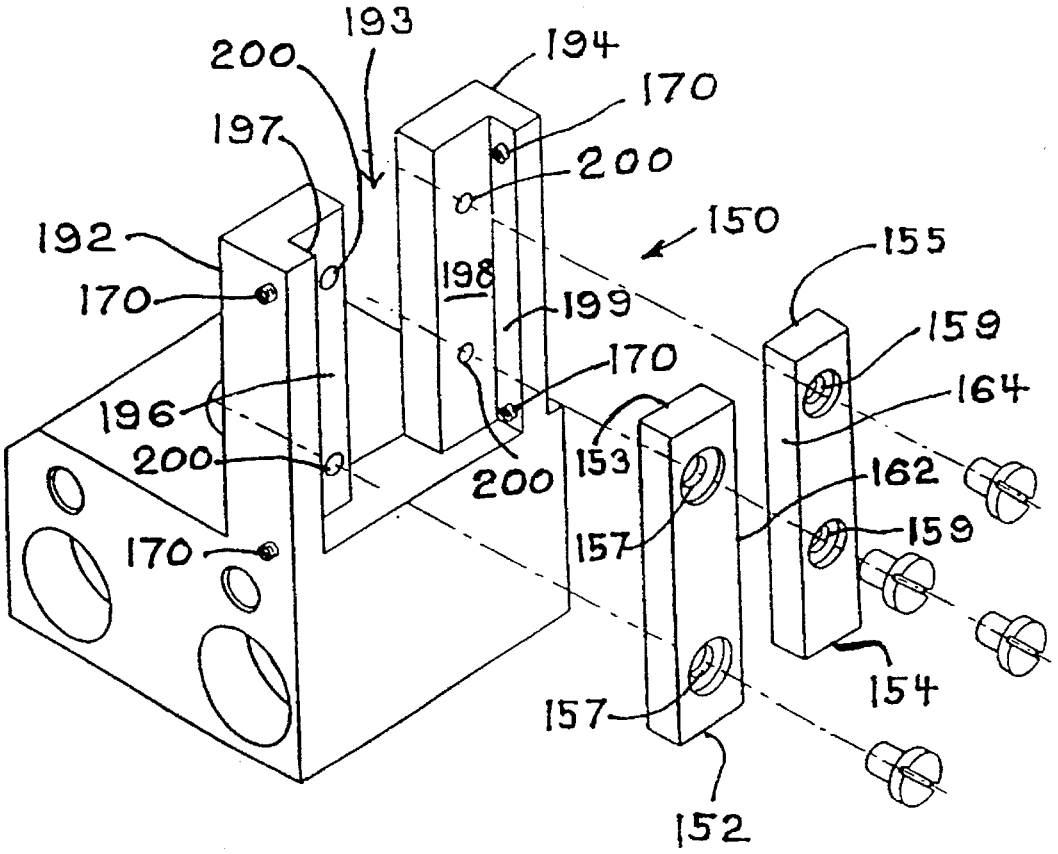
FIG. 7 is an exploded perspective view of another embodiment of the guiding block and guide plates.

Referring now to FIGS. 7 another embodiment of the guiding block and guide plates is disclosed. The guiding block 150 includes a pair of upwardly projecting rectangular shaped posts 192 and 194. The posts 192 and 194 define a vertically extending slot 193 therebetween. As in the preferred embodiment, guide block 150 is fixed to the detachable head portion 14 which is a part of the sewing machine housing.

A rectangular shaped recess defined by surfaces 196, 197 and 198, 199 is formed in post 192, 194 respectfully. Adjustable and replaceable guide plates 152 and 154, having flat engaging surfaces 153 and 155 respectfully, are secured to the surfaces 196 and 198 of the recess by fasteners 198.

Guide plates 152 and 154 include stationary vertically aligned flat engaging surfaces 162 and 164 that are adapted to be in sliding engagement with the movable vertically aligned guide surfaces 112 and 114 of the feed bar guide 56. The relatively thin portions of the fasteners 198 extend through openings 157 and 159 formed in the guide plates 152 and 154 and are threaded into threaded openings 200 formed in surfaces 196 and 198. The openings 157 and 159 are larger in diameter than the relatively thin portions of the fasteners 198, thus adjustment of the guide plates 152 and 154 relative to the guiding block 150 can be accomplished. Set screws 170 are threaded into threaded openings that extend from the sides of post 192 and 194 to surfaces 197 and 199 of the recess.

This embodiment permits precise adjustment of the guide plates 152 and 154. When adjustment is required, the fasteners 198 are loosened slightly such that they retain the guide plates against surfaces 196, 198 but permit movement relative thereto. The set screws 170 are then driven in or out to properly seat the stationary vertically aligned flat engaging surfaces 162 and 164 against the movable vertically aligned guide surfaces 112 and 114 of the feed bar guide 56.

It is intended that the accompanying drawings and foregoing detailed description is to be considered in all respects as illustrative and not restrictive, the scope of the invention is intended to embrace any equivalents, alternatives, and or modifications of parts that fall within the spirit and scope of the invention, and all changes which come within the meaning and range of equivalency of the claims are therefore intended to be embraced therein.

What is claimed is:

1. In a sewing machine of the type having a housing, a work support surface, a presser foot bar including a lower end, a presser foot bar guide mechanism carried by said housing, a roller presser bar comprising a lower end, said bars being mounted for vertical reciprocation in said housing relative to the work support surface, a presser foot secured to the lower end of said presser foot bar, a feed roller frame secured to the lower end of said roller presser bar for movement therewith, a feed roller shaft journaled in said feed roller frame, a feed roller mounted on said feed roller shaft and having a periphery that is adapted to engage a work piece that is supported on said work support surface, wherein the improvement comprises:

a roller presser bar guide mechanism carried by the housing for guiding said roller presser bar independently of said presser foot bar such that said presser foot and said feed roller can reciprocate vertically, independently of each other;

a guide block fixed to said sewing machine housing, a pair of guide plates each being adjustably secured to said guide block, and each of said guide plates having a stationary vertically aligned guide surface;

a feed bar guide fixed to said roller presser bar, said feed bar guide having a pair of movable vertically aligned guide surfaces that are in sliding contact with said stationary vertically aligned guide surfaces;

said stationary vertically aligned guide surfaces and said pair of movable vertically aligned guide surfaces being located on said guide plates and said feed bar guide respectfully whereby when sliding contact is diminished as a result of wear said guide plates are adjusted relative to said guide block and said pair of movable vertically aligned guide surfaces reestablish sliding contact with said stationary vertically aligned guide surfaces.

2. In a sewing machine of the type having a housing and a work support surface, a needle bar mounted for vertical reciprocation in said housing, a presser foot bar mounted for vertical reciprocation in said housing relative to the work support surface, a presser foot secured to said presser foot bar, guide mechanism secured to said housing for guiding said presser foot bar, a roller presser bar, including a lower end, mounted for vertical reciprocation in said housing relative to the work support surface, wherein the improvement comprises:

roller presser bar guide mechanism carried by the housing for guiding said roller presser bar independently of the presser foot bar and said presser foot bar guide mechanism to insure that said roller presser bar is free to reciprocate vertically in said housing independently of the vertical reciprocation of said presser foot bar and presser foot;

said roller presser bar includes a feed roller frame secured to the lower end of said roller presser bar and a feed roller mounted on said feed roller frame, said feed roller having a periphery that is adapted to engage a work piece that is supported on said work support surface;

said roller presser bar guide further includes a guide block fixed to said sewing machine housing and a pair of guide plates each being adjustably secured to said guide block, each of said guide plates having a stationary vertically aligned guide surface;

a feed bar guide fixed to said roller presser bar, said feed bar guide having a pair of movable vertically aligned guide surfaces;

said stationary vertically aligned guide surfaces and said pair of movable vertically aligned guide surfaces being located on said guide plates and said feed bar guide respectfully whereby when sliding contact is diminished as a result of wear said guide plates are adjusted relative to said guide block and said pair of movable vertically aligned guide surfaces reestablish sliding contact with said stationary vertically aligned guide surfaces.

3. In a method for independently guiding the roller presser bar in a sewing machine of the type having a housing, a work support surface, a roller presser bar mounted for vertical reciprocation in said housing relative to the work support surface, comprising the steps of:

(a) fixing a guide block to the sewing machine housing;

(b) securing a pair of guide plates, each of which includes a guide surface, to the guide block such that each guide surface is vertically aligned;

(c) fixing a roller presser bar guide having a pair of vertically aligned guide surfaces to the roller presser bar; and (d) adjusting the pair of guide plates relative to the guide block whereby when the guide plates are adjusted the vertically aligned guide surfaces remain in sliding contact with the vertically aligned guide surfaces of the roller presser bar.

4. The method as set forth in claim 3 wherein the following additional step is performed after wear has occurred on the vertically aligned guide surfaces:

(e) readjusting the pair of guide plates relative to the guide block to compensate for wear that has occurred to the vertically aligned guide surfaces of the feed bar guide and/or the vertically aligned guide surfaces of the feed bar guide whereby the vertically aligned guide surfaces of the roller presser bar guide reestablish sliding contact with the vertically aligned guide surfaces of the guide block during continued vertical reciprocation of the roller presser bar.

* * * * *